United States Patent [19]

Schuster

[11] 3,964,248

[45] June 22, 1976

[54] FALSE TWISTING DEVICES

[75] Inventor: Friedrich Schuster, Hammelburg, Germany

[73] Assignee: Kugelfischer Georg Schafer & Co., Schweinfurt, Germany

[22] Filed: June 12, 1975

[21] Appl. No.: 586,377

[30] Foreign Application Priority Data

June 12, 1974 Germany ..... 2428513

[52] U.S. Cl. ..... 57/77.4

[51] Int. Cl.[2] ..... D02G 1/04; D02G 1/00

[58] Field of Search ..... 57/77.4, 77.45

[56] References Cited

UNITED STATES PATENTS

| | | | |
|---|---|---|---|
| 2,939,269 | 6/1960 | Dobson | 57/77.4 |
| 3,820,317 | 6/1974 | Rrschle | 57/77.4 |
| 3,872,661 | 3/1975 | Eaves | 57/77.4 |
| 3,885,378 | 5/1975 | Schuster | 57/77.4 |
| 3,901,011 | 8/1975 | Schuster | 57/77.4 |

*Primary Examiner*—Donald E. Watkins

*Attorney, Agent, or Firm*—Stevens, Davis, Miller & Mosher

[57] ABSTRACT

An apparatus for false twisting a thread has three spindles each carrying friction elements and disposed, in plan view, at the corners of an equilateral triangle. Both ends of each of the spindles are mounted in bearings on a frame. A removable spacer is provided at each end of the frame and a resilient means urges each spindle against the spacer. The apparatus has a simple construction which can be easily disassembled to replace a spindle, friction element or bearing.

12 Claims, 2 Drawing Figures

FALSE TWISTING DEVICES

This invention relates to apparatus for false twisting synthetic threads by means of friction elements to crimp the threads.

Apparatus for false twisting thread having three spindles disposed at the corners of a triangle and each rotatably mounted at both ends in a frame and having at least one friction element on each spindle are known. Such devices are disclosed, for example, in French Patent No. 1 203 072.

In one apparatus of this kind, the frame which carries the spindles, each provided with a number of friction discs, is made in two parts. Two of the spindles are mounted in one part of the frame and the third spindle is in the other part. This other part of the frame is capable of being pivoted with respect to the first part about an axis parallel to the spindles so that the third spindle can be moved with respect to the other two. The friction discs on each spindle are axially displaced with respect to those on the other two spindles and overlap them. All three spindles are coupled together so that they rotate in the same direction when driven.

The two parts of the frame each have two mutually parallel base plates arranged spaced apart, in which each of the two spindles or the third spindle as the case may be is mounted in bearings at both ends for pivotal rotation. The manufacture and assembly of this known apparatus is relatively difficult. Also, the removal and replacement of the spindles or discs is impossible without taking the whole apparatus apart.

These difficulties are, it is true, avoided in another known false twister in which the spindles are mounted in a cantilever or overhung fashion, i.e. they are only rotatably mounted in bearings at one end of the frame. This makes it difficult to obtain an accurate parallel relationship between the spindles and makes it difficult to maintain the tolerance on the separation between the friction elements in an axial direction and the exact spacing of the three spindles from one another, which is necessary to achieve a uniform degree of twist in each of a number of false twisters (DT-AS 2 213 147).

An object of this invention is to provide a false twister of the kind described in which the above-mentioned difficulties are overcome and in which the relative radial and axial positions of the friction elements of a number of devices and likewise the degree of parallelity of the spindles can be maintained exactly the same. Another object of the invention is to provide such an apparatus which is simple to construct from simply shaped and easily manufactured components and in which the complete friction element assemblies, comprising the elements, the spindles, the bearings and driving pinion are capable of being replaced without problems. A more specific object is to provide such an apparatus having bearings in which the spindles rotate having an inner race which rotates while the outer race is stationary.

Figure 1:
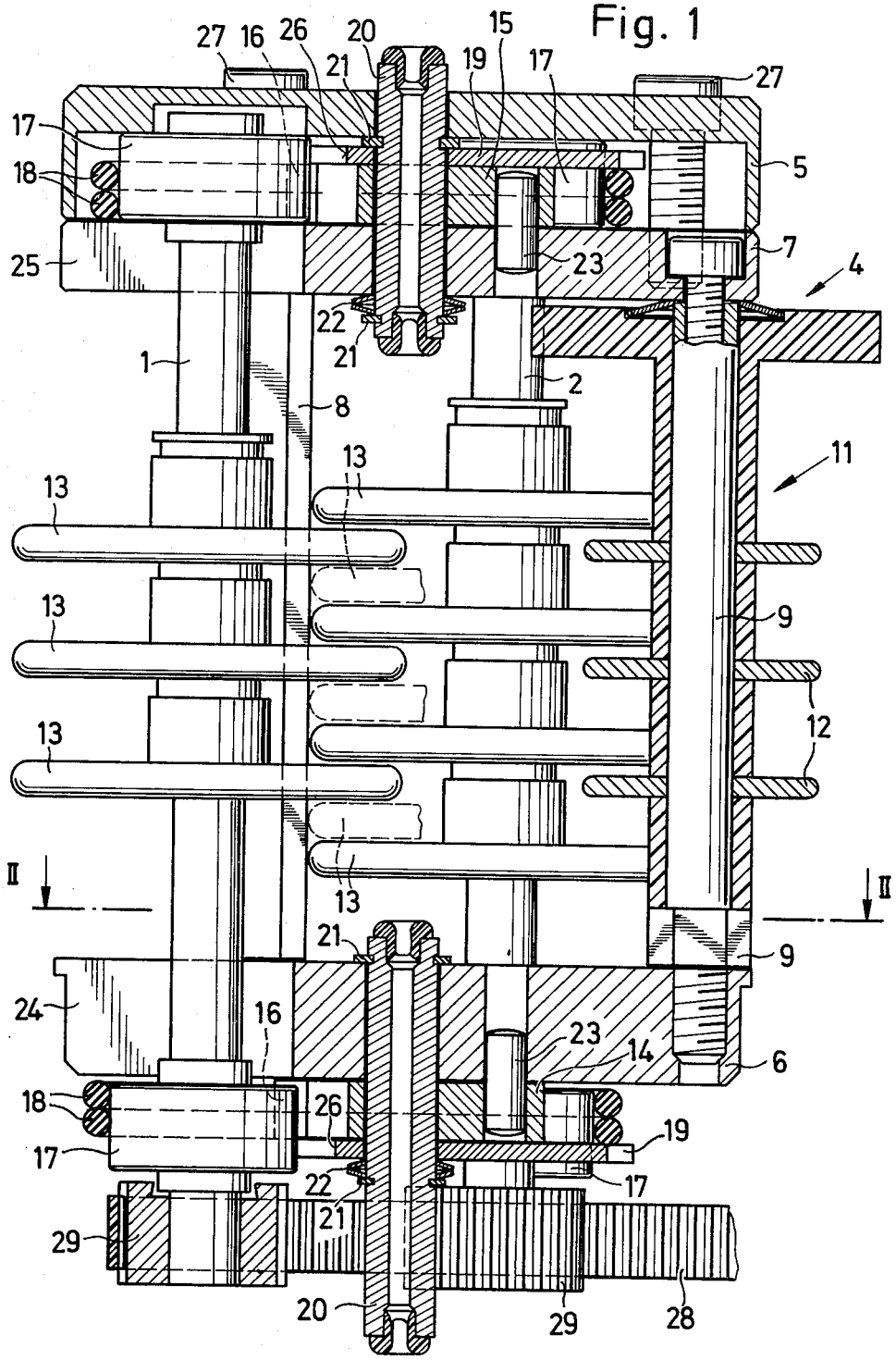
Figure 2:
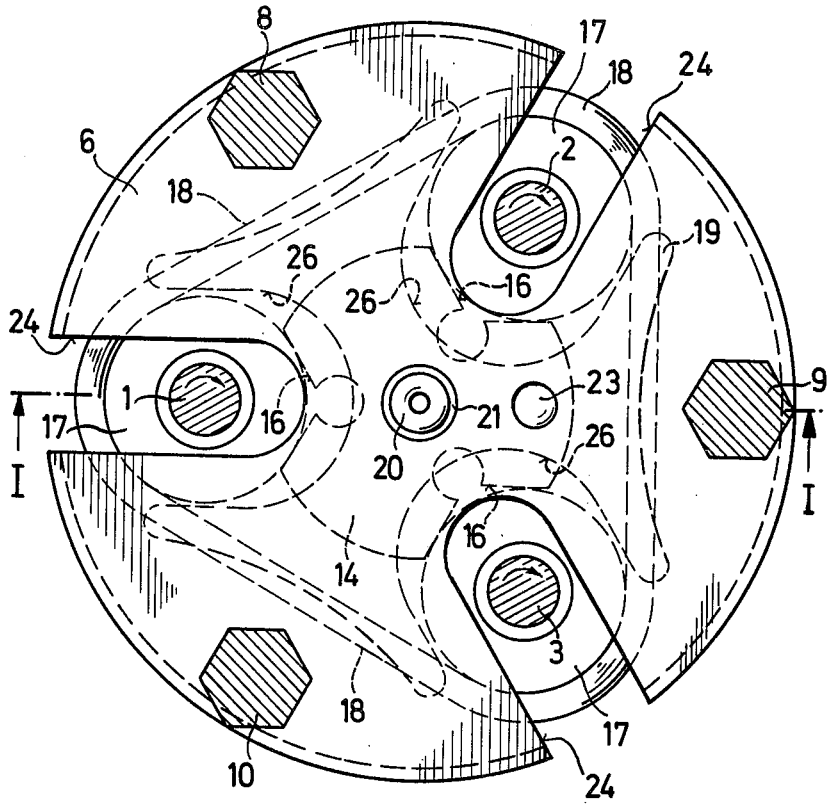

Other objects will become apparent from the following description with reference to the accompanying drawing wherein FIG. 1 is a longitudinal section taken along the line I—I in FIG. 2; and FIG. 2 is a cross-ection taken on the line II—II in FIG. 1.

The foregoing objects and others are accomplished in accordance with this invention, generally speaking, by providing a false twisting device having three spindles and a frame having a pair of spaced parallel plates on which bearings are mounted for supporting the ends of the spindles with spacer rings rigidly secured to the outer faces of the plates and having notches in which the spindles are disposed, and resilient means looped about the bearings to urge the spindles into the notches. The inner race of the bearing is secured to the spindle for rotation therewith and the outer race is disposed in the notch. A spring or other resilient means is looped about the outer races of all three bearings to urge the bearings into the notches.

Referring now to the drawing, a preferred embodiment of the apparatus is illustrated in FIGS. 1 and 2. The false twisting apparatus illustrated in the drawing has three spindles 1, 2 and 3 and a housing which comprises a frame 4 and a cover 5. The frame 4 has basically a lower base plate 6, and upper base plate 7 arranged parallel to it but spaced from it, and three vertical columns 8, 9 and 10 which connect the two circular plates 6 and 7 rigidly together and are spaced uniformly around the periphery of the plates. On the right hand column in FIG. 1 there is rotatably mounted a device 11 with tongues 12 to facilitate initial threading of the thread in the apparatus.

The spindles 1, 2 and 3 are provided, for example, with three, four and three friction discs 13, respectively. The discs 13 on each spindle 1, 2 or 3 are displaced axially with respect to the discs 13 on the other two spindles 2 and 3 as shown in FIG. 1. The position of the three discs 13 on the spindle 3 are illustrated in broken lines. In addition, the spindles 1, 2 and 3 are arranged so that they lie at the corners, in plan view, of an equilateral triangle, as shown in FIG. 2. The arrangement is such that the discs 13 on each spindle 1, 2 or 3 overlap the discs 13 on the other two spindles.

The frame 4 is provided with two ring-shaped spacers 14 and 15 against which the spindles 1, 2 and 3 are resiliently urged in an inward radial direction. The spacers 14 and 15 insure that the spindles are exactly parallel and also insure their exact mutual spacing.

Each spacer 14 and 15 is in the form of a plate with three notches 16 in the periphery to locate the three spindles 1, 2 and 3. Each spindle 1, 2 or 3 has at each end a rolling bearing 17 of which the inner race is secured to the associated spindle 1, 2 or 3 and the outer race is urged radially inwards into the notch 16 in the spacer 14 or 15. Two tension loops 18 are associated with the spacers 14 and 15 and enclosed all three of the bearings 17 at the respective end of the frame and urge the outer race inwardly. The two loops 18 of each spacer 14 and 15 are prevented from slipping off the bearings 17 by a sheet metal retainer 19.

The spacers 14 and 15 are each mounted on the outer face of the associated face plate 6 or 7 of the frame 4, and the retainers 19 are each provided on the other face of the adjacent spacer 14 or 15 so that the two loops 18 are trapped between the respective retainer 19 and the adjacent face plate 6 or 7. At each end of the frame a central hollow bushing 20 passes through the face plate 6 or 7, the spacer 14 or 15 and the retainer 19 and these parts are held together by two spring rings 21 fitted onto the two ends of bushing 20, a spring element 22 in the form of a plate spring or Belleville washer being provided between one of the two spring rings 21 and the adjacent retainer 19 or the adjacent face plate 7 so that the face plate 7, the spacer ring 14 and retainer 19 are resiliently clamped together. The two bushings 20 form a thread guide or balloon preventer.

The two spacers 14 and 15 are each secured by a retaining peg 23 against rotation with respect to the adjacent face plate 6 or 7, so that the spindles 1, 2 and 3, which each pass freely through two radial slots 24 and 25 in the face plates 6 and 7, are securely located and retained. The radial slots 24 and 25 do not serve to guide the spindles and have appreciable clearance, as shown in FIG. 2.

Also each sheet metal retainer 19 has three radial slots 26 into which the three bearings 17 at the respective end of the frame project in order to secure the retainer 19 against rotation.

To locate the three spindles 1, 2 and 3 axially the outer races of the upper bearings 17 are clamped between the upper face plate 7 and the cover 5. The cover 5 is secured to the frame 4 and its face plate 7 by screws 27. In this way the required uniform separation between adjacent friction discs 13 is easy to maintain.

The apparatus is distinguished by its simple construction from simple, easily manufactured, components and is easy to assemble. Moreover, not only are the friction disc assemblies, each comprising the spindles 1, 2 or 3 and the discs 13 on it and bearings 17, easy to replace, but also the spacers 14 and 15 are easy to replace as well, in order, for example, to alter the spacing between the spindles. At the same time the spindles are maintained exactly parallel and an accurate mutual spacing between the spindles and exact mutual axial spacing between the discs 13 are also maintained so that these parameters can be maintained uniform over a number of false twisters which are arranged, for example, on one and the same crimping machine, that is to say the parameters are repeatable.

In operation the three spindles 1, 2 and 3 are driven in the same direction of rotation, as indicated by the arrows in FIG. 2, by a toothed belt 28 which passes around three toothed rollers 29 attached to the ends of the spindles 1, 2 and 3 which are remote from the cover 5. The thread which is to be false-twisted (not shown) passes through the upper bushing 20 in FIG. 1, then in a zig-zag path between the friction discs 13 on the three spindes 1, 2 and 3 and then through the lower bushing 20 in FIG. 1 and out of the apparatus. When the thread has been threaded up in the apparatus it is initially held by the device 11 in a swung-aside position in which it is out of contact with the discs 13 and is therefore not caused to rotate. Then the device 11 is rotated into a position in which the thread lies in a stable intermediate position in which it has imparted to it only a fraction of the full rotation, for example, 25 to 50%. Thereafter, the thread is moved by the device 11 into the true false twisting position with only the minimum of lateral acceleration. In this way the speed of rotation of the thread builds up gradually and the reduction in length of the thread caused by imparting a twist and the extension of the thread caused by the adoption of the zig-zag path likewise take place gradually, keeping to a minimum the danger of the thread breaking.

The face plate 6, spacer 14 and retainer 19 at one end of the frame must be aligned with the face plate 7, the spacer 15 and the retainer 19 at the other end so that the radial slots 24 and 25 in the face plates 6 and 7, the radial slots 26 in the retainers 19 and the notches 26 in the peripheries of the spacers 14 and 15 at one end of the frame lie opposite those at the other end.

In order to achieve this as accurately as possible for the spacers 14 and 15, it is preferably arranged that the three pairs of notches 26 in the spacers 14 and the two pairs of holes for the two pegs 23 and the bushings 20 are all machined simultaneously at a common setting of the spacers 14 and 15, and furthermore, also the pairs of holes in the two face plates 6 and 7 for the pegs 23 and the pairs of holes in the two face plates 6 and 7 for the two bushings 20 are all bored in one and the same machining step at the same setting of the frame 4.

Although the invention is described in detail for the purpose of illustration it is to be understood that such detail is solely for that purpose and that variations can be made therein by those skilled in the art without departing from the spirit and scope of the invention except as it may be limited by the claims.

What I claim is:

1. An apparatus for false twisting threads by crimping whcih comprises three spindles each rotatably mounted at both ends in a common frame and each provided with at least one rotationally symmetrical friction element, the spindles lying at the corners, in plan view, of an equilateral triangle, means for passing a thread which is to be provided with a false twist between the friction elements in a zig-zag path, two mutually aligned removable spacers, one at each end of the frame, and means for resiliently urging the spindles against the spacers.

2. The apparatus according to claim 1 wherein bearings having outer races are provided at the ends of the spindles and the spindles are urged against a spacer at at least one end through the outer races of the bearings.

3. The apparatus according to claim 2 wherein the outer races of the bearings are clamped to one end of the frame to locate the spindles axially.

4. The apparatus according to claim 2 comprising at least one tension loop on each spacer which urges the spindles radially inwards against the spacer.

5. The apparatus according to claim 4 wherein a sheet metal retainer for the tension loop is associated with each spacer.

6. The apparatus according to claim 1 comprising a bushing which locates each spacer centrally on the frame and forms a thread guide, and means for securing said bushing against rotation.

7. The apparatus according to claim 1 wherein the frame has radial slots and the spindles pass with clearance therethrough.

8. The apparatus of claim 7 wherein each spacer is in the form of a plate and is provided with three peripheral notches to locate a spindle.

9. The apparatus according to claim 8 wherein each retainer has three radial slots into which the respective adjacent bearing projects, the outer race of the bearing urging the associated spindle through the medium of the tension loop, said loops trapped between the retainer and the frame into the peripheral notch of the spacer, said spacer lying between the retainer and the frame.

10. The apparatus according to claim 9 wherein each bushing passes through the plate-shaped spacer and the retainer and a face plate forming part of the frame and lying on the opposite side of the spacer from the retainer and connects the said three parts together by means of two spring rings fitted on both ends of the bushing.

11. The apparatus according to claim 10 wherein a spring element is provided between a spring ring and the adjacent retainer or the adjacent face plate.

12. An apparatus for false twisting a thread comprising three spindles and a frame having a pair of plates with inner and outer faces, means for supporting the plates in spaced parallel relation, a spacer ring mounted on the outer face of each plate, a notch in each spacer ring for each spindle, a bearing for each spindle mounted on each plate and having an inner race secured to the spindle and an outer race disposed in said notch, resilient means looped about the said outer races of the bearings urging them into the notches, and means for retaining the resilient means about the outer races.

* * * * *